US007118397B1

(12) United States Patent
Su et al.

(10) Patent No.: US 7,118,397 B1
(45) Date of Patent: Oct. 10, 2006

(54) MEMORY CARD CONNECTOR WITH CARD EJECTION MECHANISM

(75) Inventors: Yu-Hung Su, Tucheng (TW); Kuo Cheng Wang, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/305,099

(22) Filed: Dec. 19, 2005

(30) Foreign Application Priority Data

Feb. 4, 2005 (TW) ..... 94202165 U

(51) Int. Cl.
*H01R 13/62* (2006.01)

(52) U.S. Cl. ..... 439/159; 439/607

(58) Field of Classification Search ..... 439/159, 439/160, 607, 609
See application file for complete search history.

(56) References Cited

U.S. PATENT DOCUMENTS 6,508,402 B1 * 1/2003 Takada et al. ..... 235/451
6,655,973 B1 * 12/2003 Ji et al. ..... 439/159
6,746,256 B1 * 6/2004 Wang ..... 439/159
6,948,960 B1 * 9/2005 Chen ..... 439/159
6,951,471 B1 * 10/2005 Chen ..... 439/159
2004/0092146 A1 * 5/2004 Tien ..... 439/159

* cited by examiner

*Primary Examiner*—James R. Harvey
(74) *Attorney, Agent, or Firm*—Rosenberg, Klein & Lee

(57) ABSTRACT

A memory card connector includes an insulating housing, a cover engaging with the insulating housing, a plurality of terminals fixed on the insulating housing and an ejection mechanism. The insulating housing has a base plate and a side wall. The base plate has a stopper which extends upward near to the side wall. The ejection mechanism has a slider and a spring. One end of the slider leans against the stopper detachably, and the other end leans against the spring. The spring is compressed between the insulating housing and the slider. Furthermore, a first tilt-preventing portion is provided at the end of the slider which leans against the spring. A corresponding second tilt-preventing portion is provided in the side wall of the insulating housing for engaging with the first tilt-preventing portion to prevent the slider from tilting.

3 Claims, 7 Drawing Sheets

MEMORY CARD CONNECTOR WITH CARD EJECTION MECHANISM

FIELD OF THE INVENTION

The present invention generally relates to a memory card connector, more particularly to a memory card connector with card ejection mechanism.

THE RELATED ART

A prior memory card connector is disclosed in U.S. Pat. No. 6,508,402 issued on Jan. 21, 2003, which includes an insulating housing having a stopper, a plurality of terminals fixed in the insulating housing, a cover engaging with the insulating housing to form a holding space for holding a memory card and an ejection mechanism ejecting the memory card from the holding space. The ejection mechanism has a slider and a spring. When the ejection mechanism is assembled in the insulating housing, the spring is compressed between the insulating housing and the slider, and the slider is pushed to press the stopper by resilient fore of the spring.

It is obvious that the spring is deformed under the compression of the insulating housing and the slider in the assembly. The deformed spring will bias the slider and make the slider rotate upward around its end that presses the stopper, hence the slider is often ejected from the insulating housing during assembling thereof. Therefore the assembly of the prior memory card connector is troublesome, which is hindrance to increase production efficiency.

SUMMARY OF THE INVENTION

An object of the present invention is to provide a memory card connector with card ejection mechanism, which can prevent the slider of the ejection mechanism from being ejected out during assembling the ejection mechanism in the insulating housing of the memory card connector.

To achieve the above object, the present invention provides a memory card connector with card ejection mechanism including an insulating housing, a cover engaging with the insulating housing to form a holding space for receiving a memory card, a plurality of terminals and an ejection mechanism. The insulating housing has a base plate and a side wall. The base plate has a stopper which extends upward near to the side wall. The terminals are fixed on the base plate. The ejection mechanism has a slider and a spring. One end of the slider leans against the stopper detachably, and the other end of the slider leans against the spring. The spring is compressed between the insulating housing and the slider. Furthermore, a first tilt-preventing portion is provided at the end of the slider which leans against the spring. A corresponding second tilt-preventing portion is provided in the side wall of the insulating housing for engaging with the first tilt-preventing portion.

According to the mentioned above, when the memory card connector is assembled, the first tilt-preventing portion engages with the corresponding second tilt-preventing portion. Therefore the slider is prevented from tilting and from being ejected from the insulating housing. As a result, the assembly of the memory card connector is facilitated, and the production efficiency can be improved.

BRIEF DESCRIPTION OF THE DRAWINGS

The present invention will be apparent to those skilled in the art by reading the following description of embodiment thereof, with reference to the attached drawings, in which.

DETAILED DESCRIPTION OF THE PREFERRED EMBODIMENT

Figure 1:
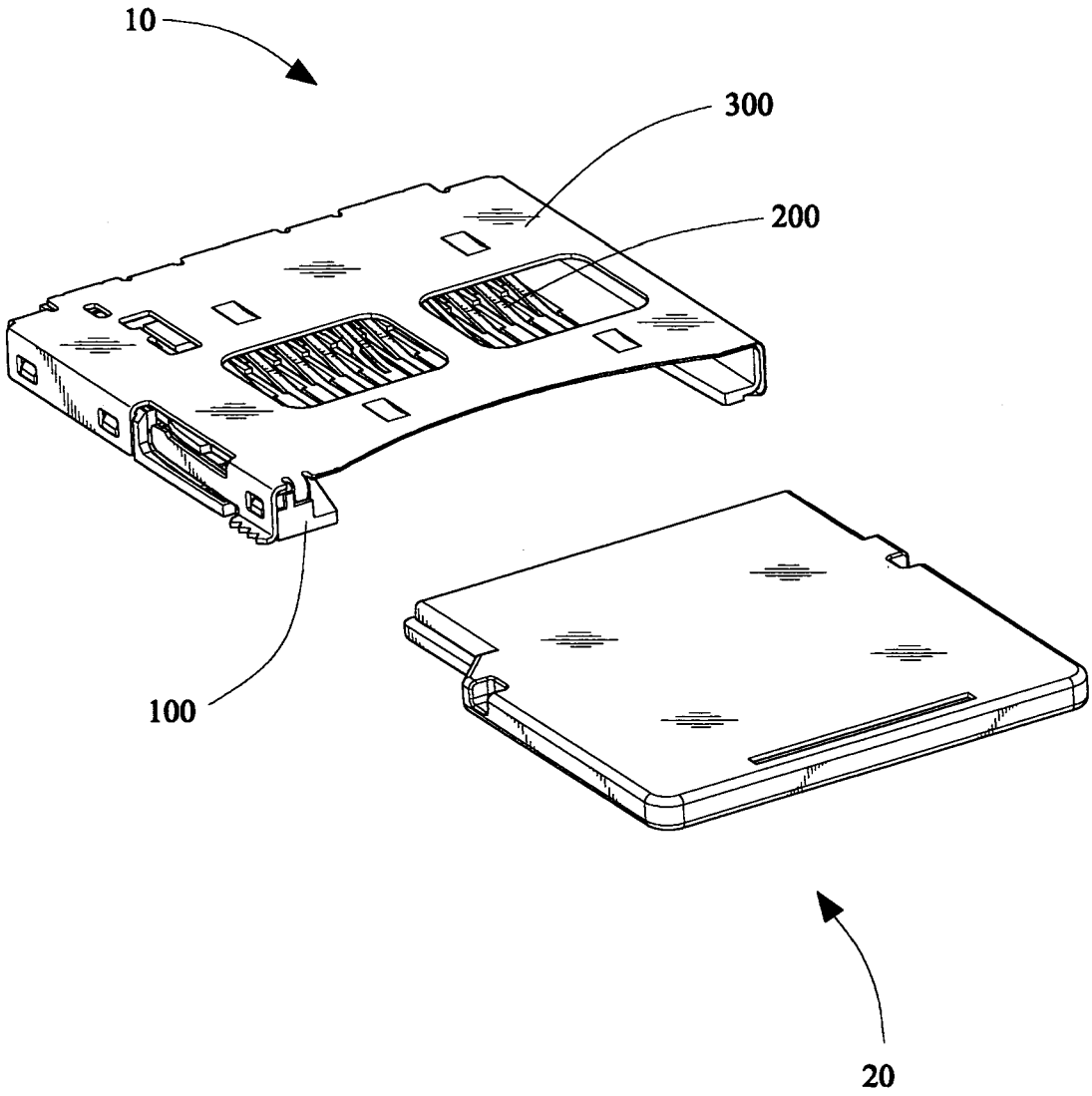
FIG. 1 is a perspective view of a memory card connector according to the present invention.
Figure 2:
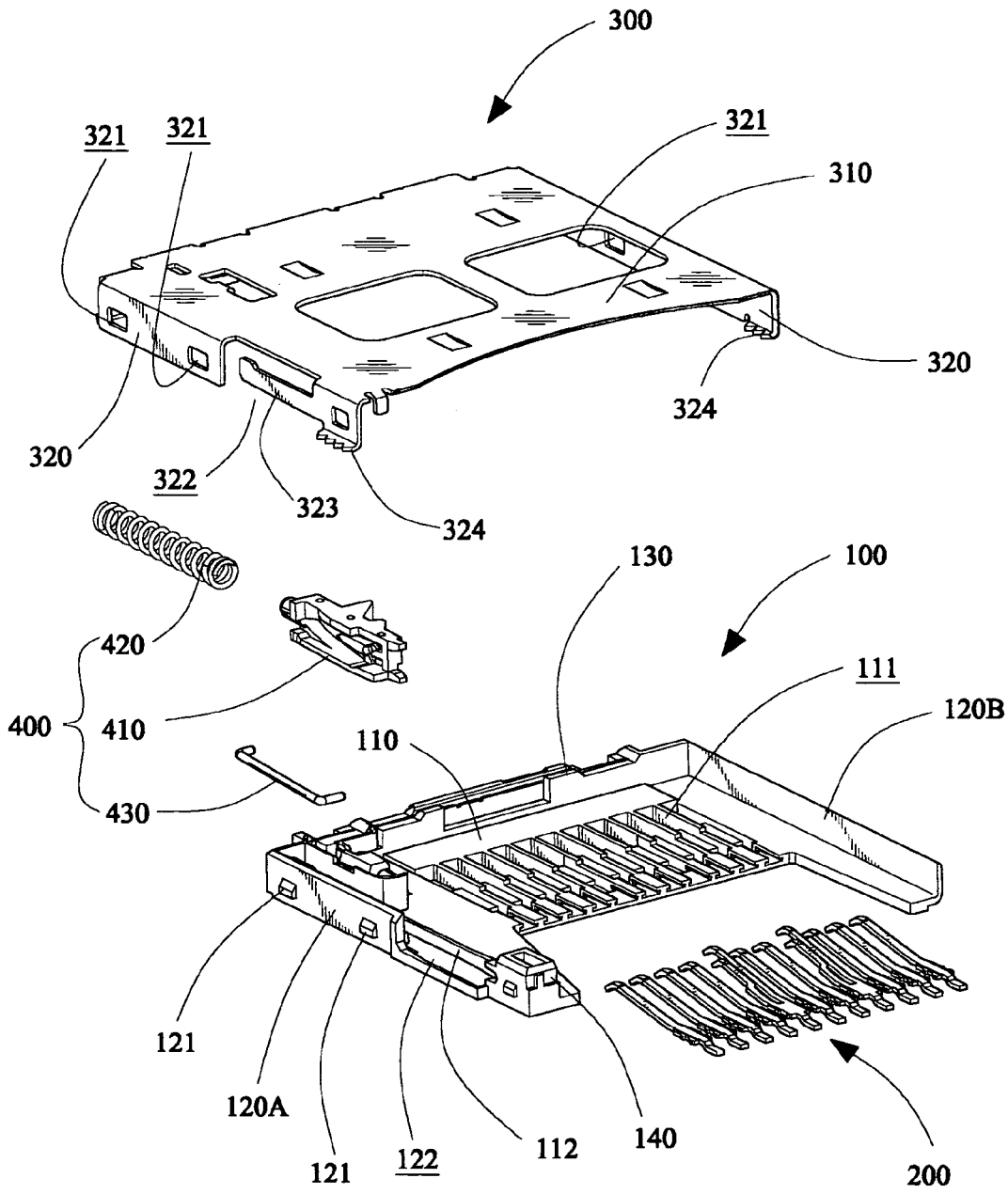
FIG. 2 is an exploded, perspective view of the memory card connector shown in FIG. 1.

With reference to FIG. 1 and FIG. 2, a memory card connector 10 according to the present invention is shown. The memory card connector 10 includes an insulating housing 100, a plurality of terminals 200 fixed on the insulating housing 100, a cover 300 which engages with the insulating housing 100 to form a holding space for holding a memory card 20 and an ejection mechanism 400 which ejects the memory card 20 from the holding space.

Figure 3:
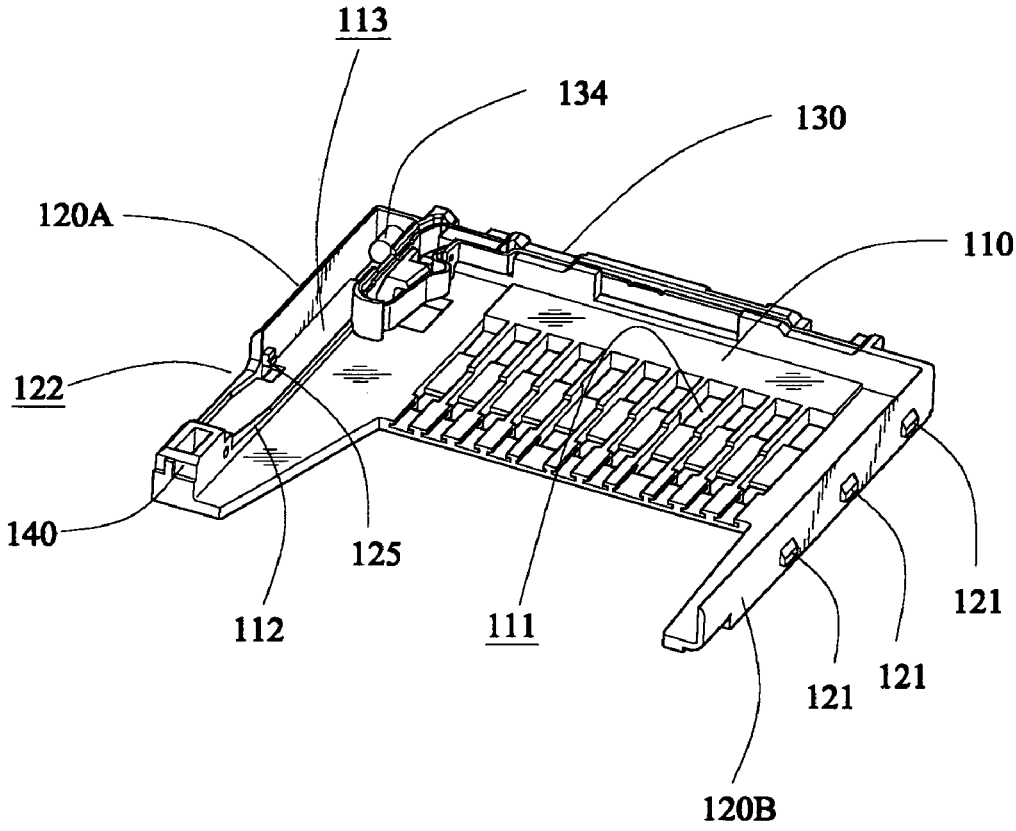
FIG. 3 is a perspective view of an insulating housing of the memory card connector shown in FIG. 1.

The cover 300 has a top plate 310 and two side plates 320 which are bend downward from both side edges of the top plate 310 respectively, and a plurality of fixing holes 321 are formed in each side plate 320. One side plate 320 is provided with a first opening 322, and a pressing member 323 is provided at the front end thereof and extended into the first opening 322. Furthermore, a soldering leg 324 is extended from the front end of each side plate 320, which is soldered on a PCB (not shown) by means of SMT Along with reference to FIG. 3, the insulating housing 100 has a base plate 110 provided with a plurality of cavities 111 for fixing these terminals 200. Two side walls 120A, 120B and a rear wall 130 are extended upward from both side edges and rear edge of the base plate 110 respectively, and the side walls 120A, 120B, a rear wall 130 and the top plate 310 of the cover 300 enclose the holding space for the memory card 20 inserted therein. A stopper 140 is provided near to the side wall 120A at the front end of the base plate 110. A rib 112 is formed on the base plate 110 and extended parallel with the side walls 120A to form a sliding slot 113 therebewteen. The sliding slot 113 leads the ejection mechanism 400 to slide therein in the direction of insertion and ejection of the memory card 20.

Each side walls 120A, 120B provides with a plurality of fixing blocks 121 in the outside thereof engaging with the fixing holes 321 of the side plates 320 to fix the cover 300 on the insulating housing 100. A second opening 122 is formed between the side wall 120A and the stopper 140 aligning with the first opening 322 to form a space for the pressing member 323 being biased therein. The second tilt-preventing portion is formed near to the second opening 122 in the inside of the side wall 120A. In the present embodiment, the second tilt-preventing portion is a preventing block 125. A first pole 134 is provided on the inside of the rear wall 130 near to the side wall 120A.

Figure 4:
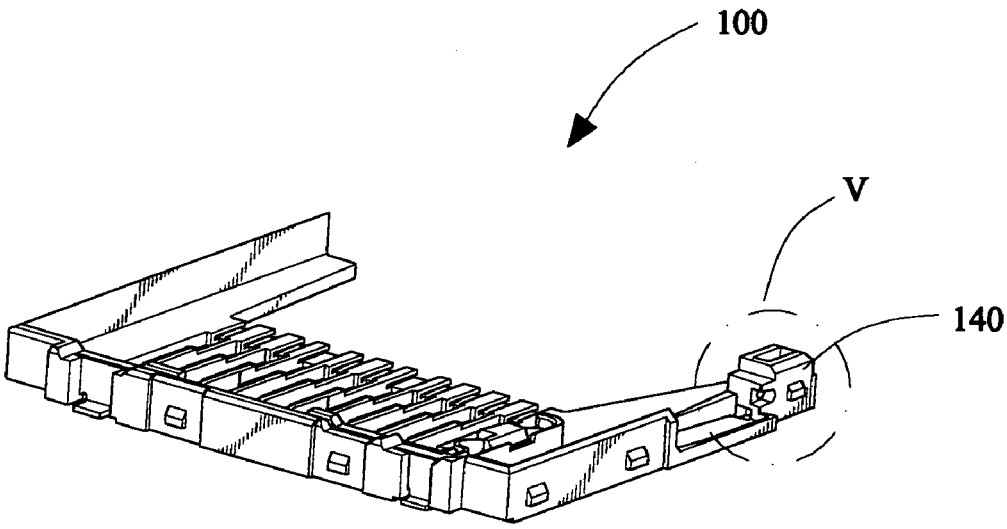
FIG. 4 is another perspective view of the insulating housing shown in FIG. 3.
Figure 5:
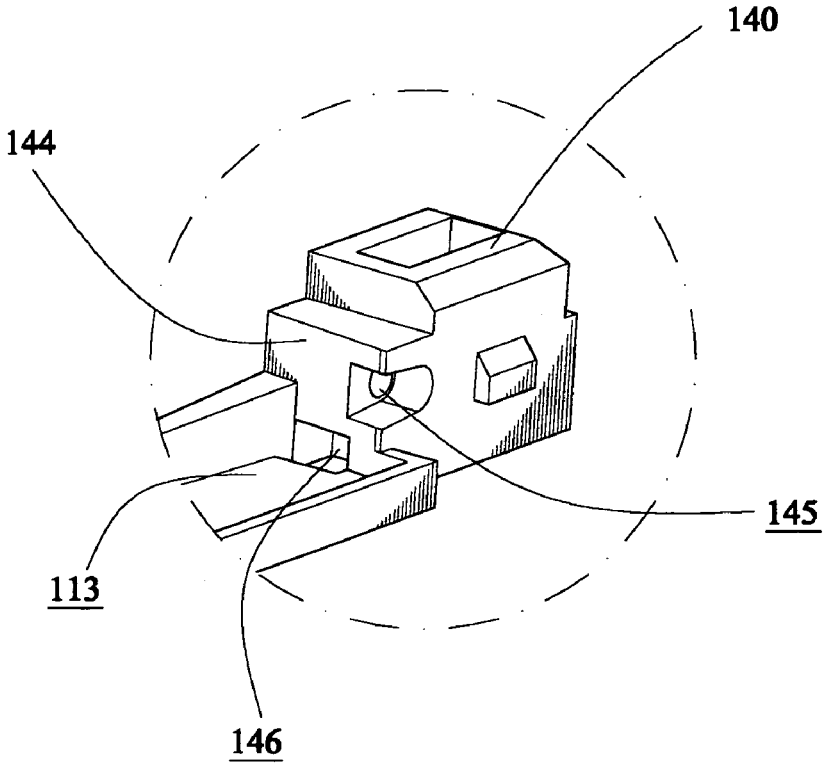
FIG. 5 is an enlarged view of a circled part that is labeled by V in FIG. 4.

With reference to FIG. 4 and FIG. 5, when the card 20 is ejected out from the memory card connector 10, the stopper 140 leans against the ejection mechanism 400 to prevent the ejection mechanism 400 from sliding more. An engaging mass 144 is extended from the side of the stopper 140 facing to the sliding slot 113, and a pivotal hole 145 is defined in the engaging mass 144 extending in transverse direction. An engaging dent 146 is formed between the engaging mass 144 and the base plate 110 of the insulating housing 100.

Figure 6:
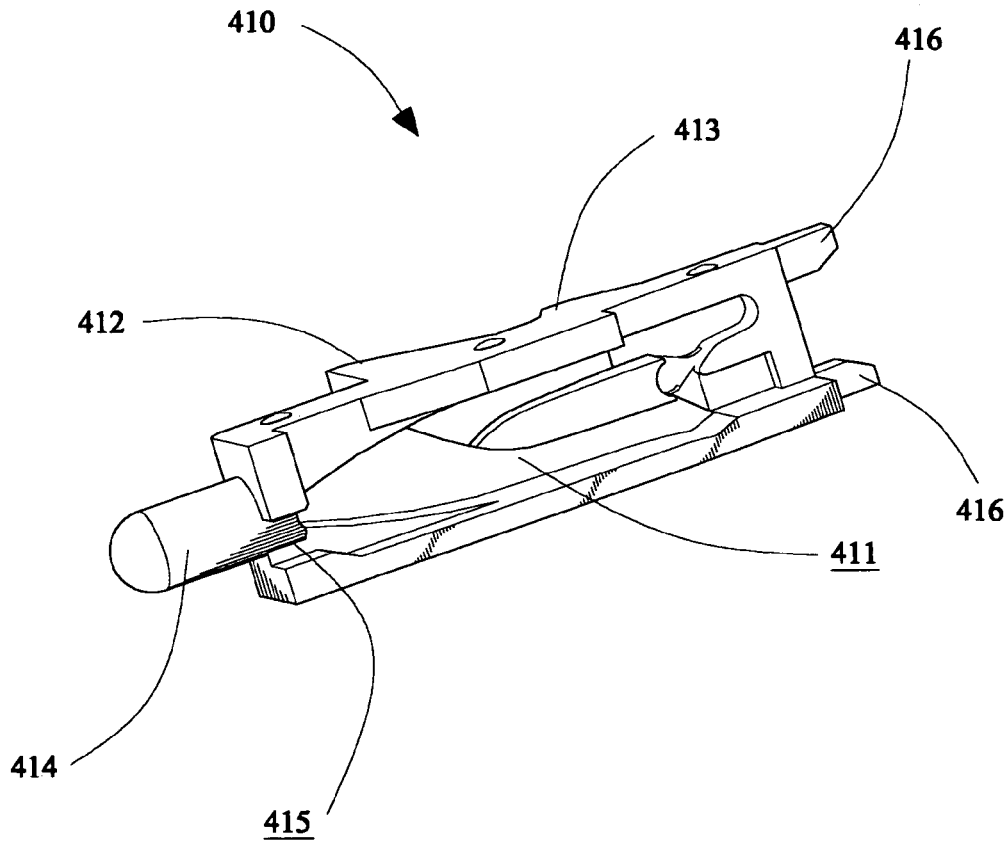
FIG. 6 is a perspective view of an ejection mechanism of the memory card connector shown in FIG. 2.

With reference to FIG. 2 and FIG. 6, the ejection mechanism 400 includes a slider 410, a spring 420 and a pivotal pin 430. A cam slot 411 is formed in the outside of the slider 410, and a card engagement portion 412 and a locking portion 413 are provided in the inside of the slider 410. One end of the slider 410 provides a second pole 414, and near to this end a first tilt-preventing portion is formed in the outside of the slider 410. In the present embodiment, the first tilt-preventing portion is a preventing slot 415 which extends in the insertion direction of the memory card and communicates with the cam slot 411. The other end of the slider 410 leans against the stopper 140 detachably with two engaging poles 416 extended from this end.

Figure 7:
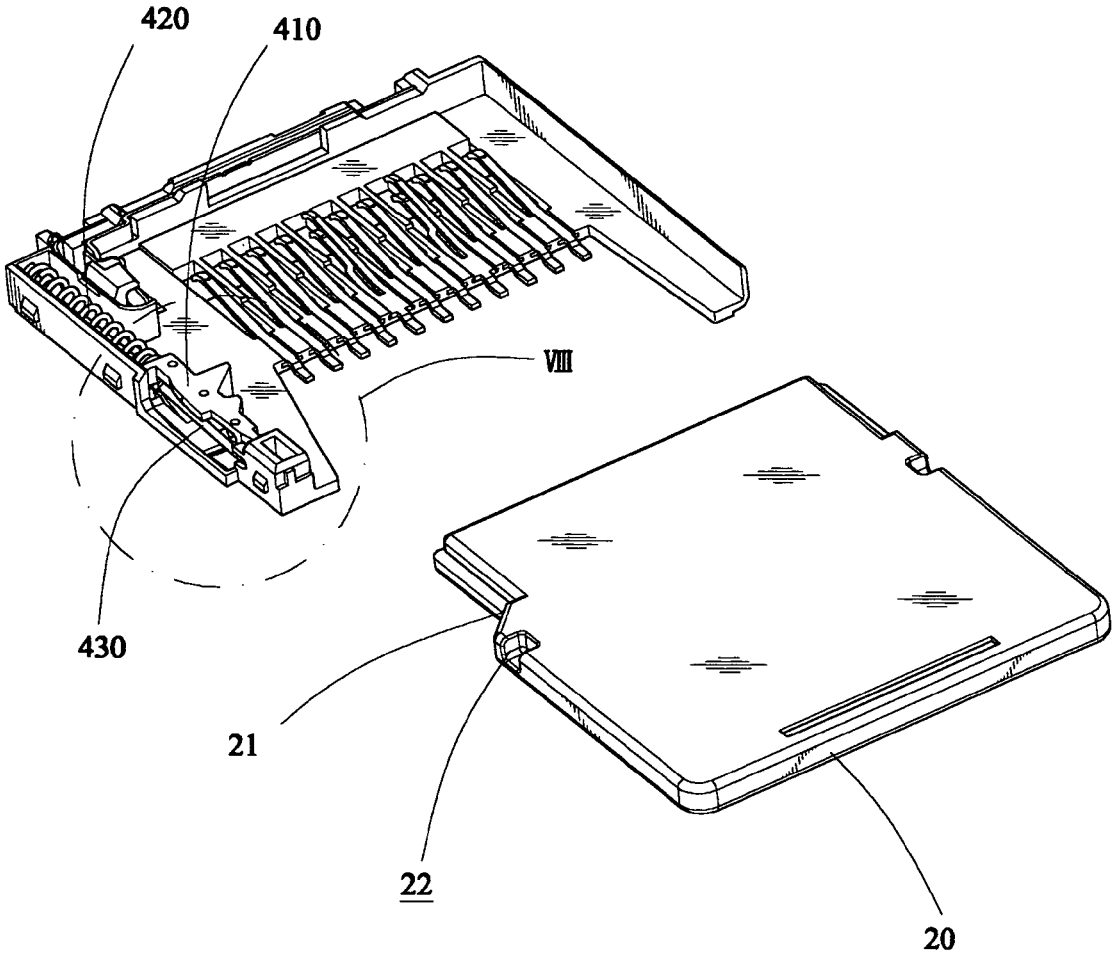
FIG. 7 is a perspective view of the memory card connector with a cover of the connector removed therefrom, and showing a memory card being about to be inserted into the connector.
Figure 8:
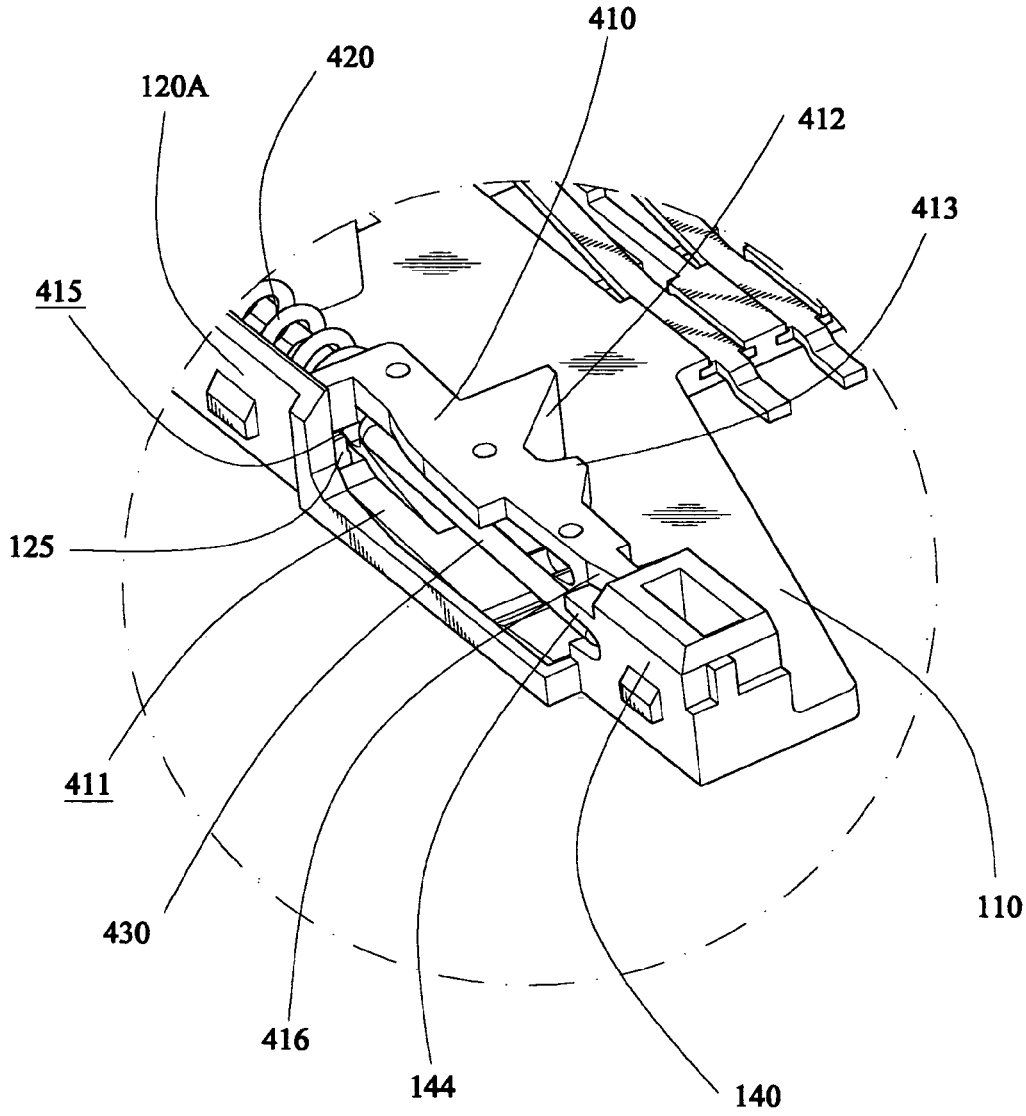
FIG. 8 is an enlarged view of a circled part that is labeled by VIII in FIG. 7.

With reference to FIG. 7 and FIG. 8, When the ejection mechanism 400 is assembled in the insulating housing 100, the slider 410 is set in the sliding slot 113. The preventing slot 415 engages with the preventing block 125 of the insulating housing 100. The engaging poles 416 engage with the engaging mass 144 of the stopper 140 with one of the engaging poles 416 inserted into the engaging dent 146. One end of the spring 420 is positioned on the first pole 134, and the other end is positioned on the second pole 414. Therefore, the spring 420 is compressed between the insulating housing 100 and the slider 410. One end of the pivotal pin 430 is inserted into the pivotal hole 145 of the stopper 140, and the other end is set in the cam slot 411 slidably.

When the memory card 20 is inserted into the memory card connector 10, an inclined plane 21 of the memory card 20 leans against the card engagement portion 412 of the slider 410 and pushes the slider 410 to slide in the insertion direction of the memory card 20. At this time, the engaging poles 416 of the slider 410 is separated from the engaging mass 144 of the stopper 140. In the above course, the pressing member 323 of the cover 300 presses the pivotal pin 430 to make it slide in the cam slot 411. The locking portion 413 of the slider 410 is engaged with a notch 22 of the memory card 20 to lock the memory card 20 in the memory card connector 10. At the time of ejecting the memory card 20, the spring 420 pushes the slider 410 to slide in the withdraw direction of the memory card 20, and the card engagement portion 412 pushes the memory card 20 out.

According to the foregoing description, the end of the slider 410 leaning against the spring 420 provides the preventing slot 415, and the side wall 120A of the insulating housing 100 provides the corresponding preventing block 125. When the ejection mechanism 400 is assembled in the insulating housing 100, the preventing block 125 engages with the preventing slot 415. Therefore the preventing block 125 can prevent the slider 410 from tilting and from being ejected from the insulating housing 100. As a result, the assembly of the memory card connector 10 is facilitated, and the production efficiency can be improved.

What is claimed is:

1. A memory card connector with card ejection mechanism, comprising:

an insulating housing having a base plate and a side wall, said base plate having a stopper which extends upward near to the side wall;

a plurality of terminals fixed on the base plate;

a cover engaging with the insulating housing to form a holding space for receiving a memory card;

an ejection mechanism having a slider and a spring, one end of the slider leaning against the stopper detachably, the other end of the slider leaning against the spring, said spring being compressed between the insulating housing and the slider;

a first engaging portion having two engaging poles and being provided from the end of the slider which leans against the stopper; and a corresponding second engaging portion being an engaging mass, said second engaging portion being provided in the side of the stopper which faces the slider, said first engaging portion engaging said second engaging portion when said slider leans against said stopper, wherein a first tilt-preventing portion is provided from the end of the slider which leans against the spring and along the side of the slider, a corresponding second tilt-preventing portion is provided on the side wall of the insulating housing, and the first tilt-preventing portion engages with the second tilt-preventing portion to prevent the slider from tilting.

2. The memory card connector with card ejection mechanism as claimed in claim 1, wherein said first tilt-preventing portion is a preventing slot which extends along the side of the slider, and said second tilt-preventing portion is a preventing block.

3. The memory card connector with card ejection mechanism as claimed in claim 1, wherein an engaging dent is formed between said engaging mass and said base plate of the insulating housing, and one of the engaging poles is inserted into the engaging dent when said slider leans against said stopper.

* * * * *